United States Patent [19]

Awazuhara et al.

[11] 4,387,586

[45] Jun. 14, 1983

[54] METHOD OF WIDTHWISE ROLLING OF ROLLED MATERIAL AND APPARATUS THEREFOR

[75] Inventors: Hiroshi Awazuhara, Katsuta; Sukebumi Tsumura, Mito; Tomoaki Kimura, Hitachi, all of Japan

[73] Assignee: Hitachi, Ltd., Tokyo, Japan

[21] Appl. No.: 200,606

[22] Filed: Oct. 24, 1980

[30] Foreign Application Priority Data

Oct. 31, 1979 [JP] Japan ..... 54-139929

[51] Int. Cl.[3] ..... B21B 15/00; B21B 47/00

[52] U.S. Cl. ..... 72/206; 72/199

[58] Field of Search ..... 72/199, 206, 365, 366, 72/406, 184, 189, 226, 229, 240

[56] References Cited

U.S. PATENT DOCUMENTS

| | | | |
|---|---|---|---|
| 1,603,518 | 10/1926 | Coates | 72/366 |
| 4,216,667 | 8/1980 | Otsuka et al. | 72/366 |

FOREIGN PATENT DOCUMENTS

| | | | |
|---|---|---|---|
| 52-66860 | 6/1977 | Japan | 72/366 |
| 53-16786 | 1/1978 | Japan | 72/365 |
| 55-10363 | 1/1980 | Japan | 72/206 |
| 55-36023 | 3/1980 | Japan | 72/199 |
| 55-50901 | 4/1980 | Japan | 72/366 |
| 55-70403 | 5/1980 | Japan | 72/206 |
| 55-153602 | 11/1980 | Japan | 72/366 |
| 269119 | 4/1970 | U.S.S.R. | 72/206 |
| 596301 | 3/1978 | U.S.S.R. | 72/366 |

*Primary Examiner*—Lowell A. Larson

*Attorney, Agent, or Firm*—Thomas E. Beall, Jr.

[57] ABSTRACT

A method and apparatus for rolling a rolled material widthwise thereof wherein the rolled material in the form of a flat metal which may be a slab of metal having a large width as contrasted with the thickness has its lengthwise end portion shaped by compression working while the rolled material remains stationary in such a manner that the lengthwise end portion is formed with a progressively reducing width portion in which the width is progressively reduced in going toward the end of the rolled material, and a uniform width portion contiguous with the progressively reducing width portion and having a width equal to the minimum width of the progressively reducing width portion between its end contiguous with the progressively reducing width portion and the end of the rolled material. Thereafter, the rolled material is subjected to widthwise rolling, whereby the fishtail produced at the end of the rolled material can be greatly diminished.

15 Claims, 13 Drawing Figures

METHOD OF WIDTHWISE ROLLING OF ROLLED MATERIAL AND APPARATUS THEREFOR

BACKGROUND OF THE INVENTION

This invention relates to methods and apparatus for rolling rolled materials widthwise thereof, and more particularly it is concerned with a method and apparatus of the type described capable of avoiding, when a slab of metal having a large width as contrasted with the thickness is rolled widthwise thereof, formation of fishtails at the lengthwise ends of the slab.

Generally, a rolled material produced by continuous casting or rolling of an ingot has its width reduced in the next operation step by means of a widthwise rolling mill having vertical rolls, so that the rolled material will have a predetermined width. When widthwise rolling of the rolled material is carried out, difficulties have been encountered in causing the rolling operation to have effects in the interior of the rolled material and elongation has tended to occur only on the surface layers thereof. As a result, the rolled material has a recess at either end thereof. The recess is referred to as a fishtail and its amount is represented by its maximum depth. The fishtail should be discarded because it is not suitable for use in industrial production, thereby causing a reduction in the yield of the rolled material.

Heretofore, it has been usual practice to regulate a pass schedule to minimize the fishtail in view of the fact that the amount of the fishtail varies depending on the pressure applied to the rolled material widthwise thereof by the rolls. Japanese Patent Publication No. 16786/78 discloses one example of the prior art. The process for avoiding formation of a fishtail has, however, been unable to achieve a success in avoiding formation of fishtails. Moreover, the process has been found to have the disadvantage that the rolled material is difficultly bitten by the rolls.

SUMMARY OF THE INVENTION

An object of the present invention is to provide a method of rolling a rolled material widthwise thereof and an apparatus therefor capable of minimizing fishtails formed at the lengthwise ends of the rolled material during the widthwise rolling operation.

Another object is to provide a method of rolling a slab of metal having a large width as contrasted with the thickness widthwise thereof and an apparatus therefor capable of minimizing fishtail formation at the lengthwise ends of the slab of metal during the widthwise rolling operation.

Still another object is to provide an apparatus for rolling a rolled material widthwise thereof capable of avoiding formation of fishtails in the rolled material efficiently and at low expenses.

According to the invention, there is provided a method of rolling a rolled material widthwise thereof characterized by comprising the step of compressing a lengthwise end portion of the rolled material by compression working prior to effecting rolling of the rolled material widthwise thereof, so that the lengthwise end portion includes a progressively reducing width portion in which the width of the rolled material is progressively reduced in going toward the lengthwise end, and a uniform width portion contiguous with the progressively reducing width portion and terminating at the lengthwise end of the rolled material. A high degree of restraint can be exerted on a deformation that might be caused by widthwise rolling by virtue of the presence of the uniform width portion which is not essentially subjected to widthwise rolling. Stated differently, the deformation that might be caused by widthwise rolling is prevented from being transmitted to the lengthwise end portion of the rolled material. Thus the fishtail can be minimized in amount, and the presence of the progressively reducing width portion facilitates biting of the rolls into the rolled material when widthwise rolling is carried out.

According to the invention, there is provided an apparatus for rolling a rolled material widthwise thereof comprising a widthwise rolling mill for rolling the rolled material widthwise thereof, such apparatus being characterized by comprising a working device comprising a pair of forming tool members located on at least one of the upstream side and the downstream side of the widthwise rolling mill along a path of the rolled material for compressing a lengthwise end portion of the rolled material by compression working so as to form at the lengthwise end portion a progressively reducing width portion in which the width of the rolled material is progressively reduced in going toward the lengthwise end of the rolled material, and a uniform width portion contiguous with the progressively reducing width portion and terminating at the lengthwise end, and means for urging the pair of forming tool members to move toward and away from each other widthwise of the rolled material.

The method and apparatus provided by the invention can impart any shape as desired to the end portion of a rolled material by simple means.

Figure 1:
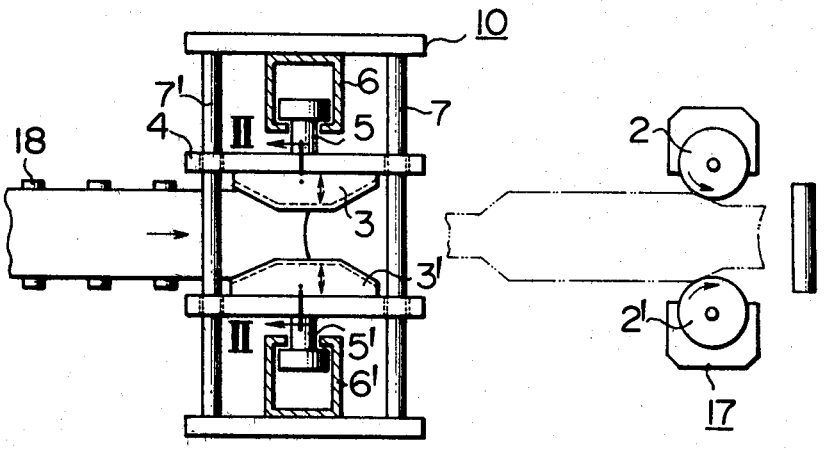
FIG. 1 is a plan view of the widthwise rolling apparatus as a whole comprising one embodiment of the invention.
Figure 2:
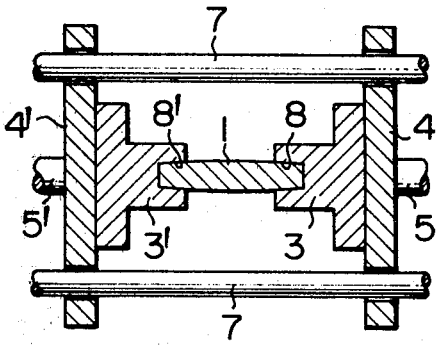
FIG. 2 is a sectional view, on an enlarged scale, of the apparatus shown in FIG. 1 as viewed in the direction of arrows II—II in FIG. 1.

The rolled material that is operated upon by the present invention has a length, as measured in the lengthwise direction that is horizontal in FIG. 1 and perpendicular to the plane of FIG. 2, a width as measured in the widthwise direction that is vertical in FIG. 1 and horizontal in FIG. 2, and a thickness substantially less than its width, as measured in the vertical direction of FIG. 2. Widthwise rolling is defined as rolling along the length of the material so as to reduce its width in the widthwise direction.

DESCRIPTION OF THE PREFERRED EMBODIMENTS

FIGS. 1 and 2 show one embodiment of the apparatus for rolling a rolled material widthwise thereof in conformity with the invention. The apparatus comprises a working device 10 located upstream of a widthwise rolling mill 17 for shaping an end portion of a rolled material 1 by compression working. The rolled material 1 is withdrawn from a heating furnace, not shown, and conveyed by rollers 18 along a path of rolling of the rolled material 1 or rightwardly in FIG. 1, and stops in a predetermined position with respect to the working device 10. While the rolled material 1 remains stationary, a leading end portion thereof is compressed by the working device 10. Then the rolled material 1 is moved again rightwardly in FIG. 1 and stops, so as to have a trailing end portion thereof compressed by the working device 10. After having its leading and trailing end portions compressed in this way, the rolled material 1 is fed to the widthwise rolling mill 17 as indicated by dash-and-dot lines where the rolled material 1 is rolled widthwise to have its width reduced to a predetermined value by rolls 2 and 2'.

The working device 10 will now be described. The working device 10 comprises a pair of shaping tool members 3 and 3' each including a pair of substantially symmetrical inclined portions which are inclined with respect to the center line of the rolled material 1 extending across the width thereof, so as to be able to shape both the leading and trailing end portions of the rolled material 1 having a thickness of between 60 and 350 mm, for example, into tapered form. The shaping tool members 3 and 3' are detachably mounted on guide plates 4 and 4' moved in reciprocatory movement widthwise of the rolled material 1 by guide rods 7 and 7' respectively. The reciprocatory movements of the guide plates 4 and 4' are given by pistons 5 and 5' in hydraulic cylinders 6 and 6' respectively. When an end portion of the rolled material 1 is shaped or when the end portion is held between the shaping tool members 3 and 3', a bulge may be formed on each widthwise edge of the rolled material 1. To cope with this phenomenon, the shaping tool members 3 and 3' are formed with grooves 8 and 8' respectively of the shape of a letter U in lying position for receiving therein opposite edge portions of the rolled material 1 so that the latter is held in position.

Figure 3:
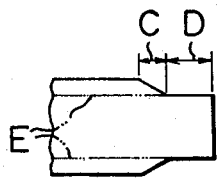
FIG. 3 is a plan view of an end portion of a rolled material showing the shape of the shaped end portion.

FIG. 3 shows the shape of an end portion of the rolled material 1 shaped by the shaping tool members 3 and 3' of the aforesaid construction. In the figure, C is a progressively reducing width portion in which the width of the rolled material 1 is progressively reduced in going toward the end of the rolled material 1, and D is a uniform width portion contiguous with the progressively reducing width portion C and having a width corresponding to the minimum width of the progressively reducing width portion C from its end contiguous with the progressively reducing width portion C to the end of the rolled material 1. Dash-and-dot lines E indicate edges of the rolled material 1 after its width is reduced by widthwise rolling. Thus, in the illustrated embodiment, the uniform thickness portion D is not essentially subjected to widthwise rolling when widthwise rolling of the rolled material 1 is carried out by the widthwise rolling mill 17.

Figure 4:
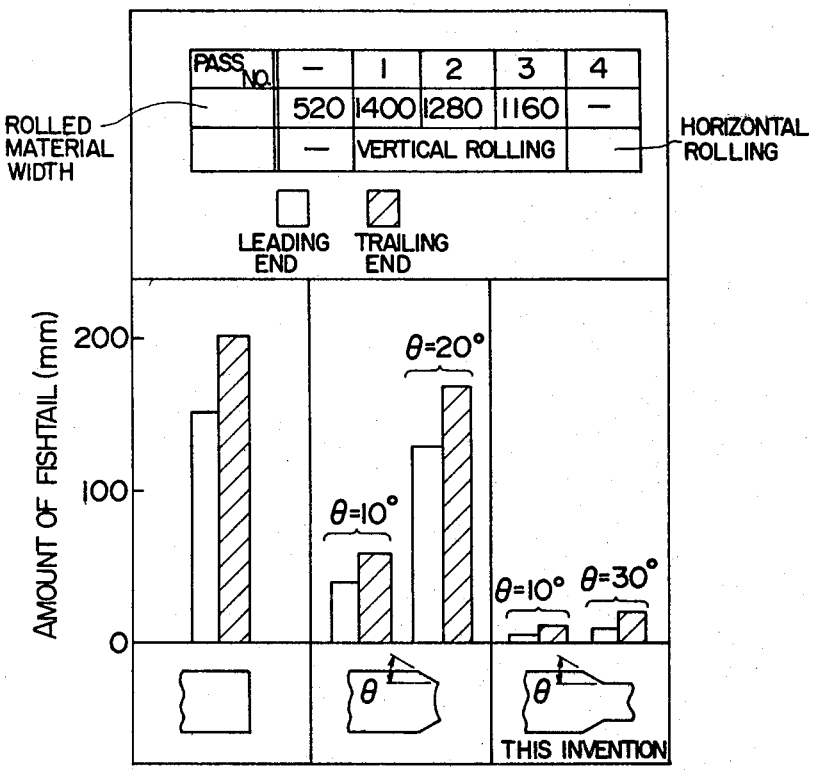
FIG. 4 is a schematic view showing the effects achieved by the invention in reducing fishtails.

FIG. 4 shows, in comparison with an amount of fishtail produced in a rolled material subjected to widthwise rolling by a method of the prior art, an amount of fishtail produced in a rolled material subjected to widthwise rolling after having its end portions shaped by the method according to the invention as described hereinabove by referring to FIGS. 1–3. In the diagram, the blank zone indicates the amount of fishtail produced at the leading end of the rolled material, and the hatched zone indicates the amount of fishtail produced at the trailing end thereof. In the rolled material rolled widthwise according to the invention, the progressively reducing width portion is tapered as shown in the right column of the diagram. In FIG. 4, it will be seen that the amount of fishtail produced in the rolled material rolled widthwise according to the invention is reduced to about 1/10 that of the fishtail produced in a rolled material subjected to widthwise rolling according to the prior art shown in the left column of the diagram.

Figure 12:
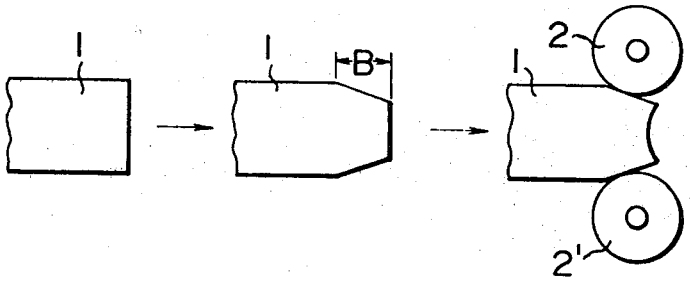
FIG. 12 is a view in explanation of a process of rolling a rolled material widthwise thereof by shaping an end portion of the rolled material into tapered form.

It has already been proposed by us to use a method and apparatus for avoiding the production of a fishtail wherein, as shown in FIG. 12, the rolled material 1 is formed with a tapered end portion B to reduce the width of the end portion of the rolled material 1, and then the rolled material 1 is subjected to widthwise rolling by the vertical rolls 2 and 2', to thereby minimize the amount of fishtail that might be produced at the end of the rolled material 1 due to widthwise rolling. The result achieved by this method is shown in the center column of the diagram shown in FIG. 4. It will be seen that the amount of fishtail produced in the rolled material 1 rolled widthwise according to the invention is reduced to about $\frac{1}{3}$ the amount of fishtail produced in the rolled material rolled widthwise by the method shown and described by referring to FIG. 12.

Figure 5:
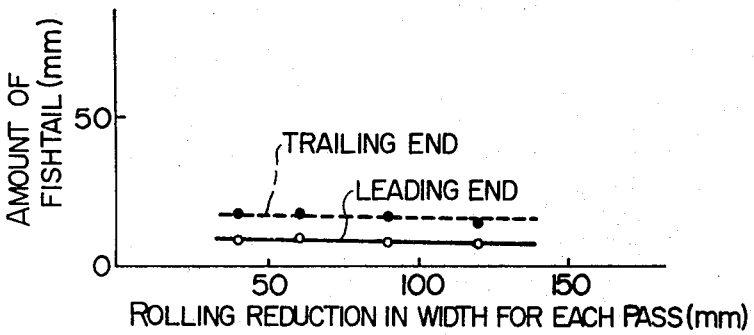
FIG. 5 is a graph showing the relation between the amount of rolling reduction in width obtained in one pass and the amount of fishtail.

FIG. 5 shows the influences exerted by variations in the amount of rolling reduction for each pass on the amount of fishtails produced in rolled materials. In the figure, it will be seen that the amount of fishtails produced in the rolled materials rolled widthwise according to the invention is very small and shows substantially no change even if the amount of rolling reduction in width is varied. FIG. 5 shows the results of experiments conducted on rolled materials having a width of 1520 mm which had a rolling reduction in width of 360 mm. The invention enables the amount of fishtail produced in rolling a rolled material widthwise thereof to be greatly reduced. The amount of fishtail produced is not influenced by the amount of rolling reduction in width for each pass, thereby providing a latitude in selecting a widthwise rolling schedule and thus facilitating the rolling operation.

Figure 6:
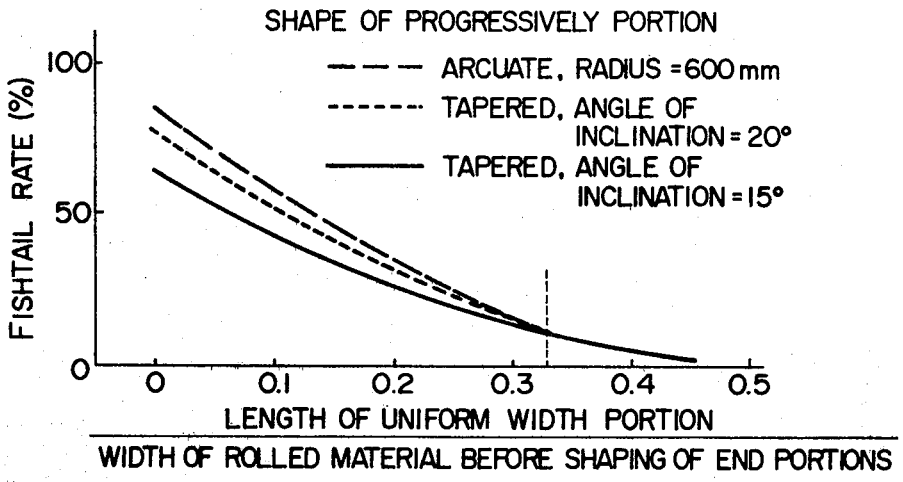
FIG. 6 is a graph showing the relation between the length of the uniform width portion and the fishtail rate in the invention.

FIG. 6 shows the results of tests conducted on the influences exerted by variations in the length of the uniform width portion of each end portion of the rolled material 1 on the amount of fishtail produced when the method according to the invention is carried into practice. In the diagram, the ordinate indicates a fishtail rate representing the amount of fishtail produced in the rolled materials rolled widthwise according to the invention shown in percentage as compared with the amount of fishtail produced in rolled materials rolled widthwise according to the prior art. In the figure, it will be seen that the greater the length of the uniform width portion, the higher are the effects achieved by the method according to the invention in reducing the amount of fishtail. In particular, it will be seen that by letting the uniform width portion have a length which is at least over $\frac{1}{3}$ the width of the rolled material before shaping, the amount of fishtail produced in the rolled material by rolling same widthwise thereof can be made substantially nil. Similar results can be obtained when the progressively reducing width portion which is tapered as shown is not straight but circularly arcuate or in other curving form. It has been ascertained that when the progressively reducing width portion is tapered, satisfactory results can be achieved if the angle of inclination $\theta$ meets the condition $\phi \leqq$ (the bitting angle at which the rolls bite into the rolled material), and that when the progressively reducing width portion is circularly arcuate or in other curving form, satisfactory results can be achieved if the angle of inclination $\theta$ in a position in which the width begins to decrease meets the condition $\phi \leqq$ (the biting angle).

Figure 7:
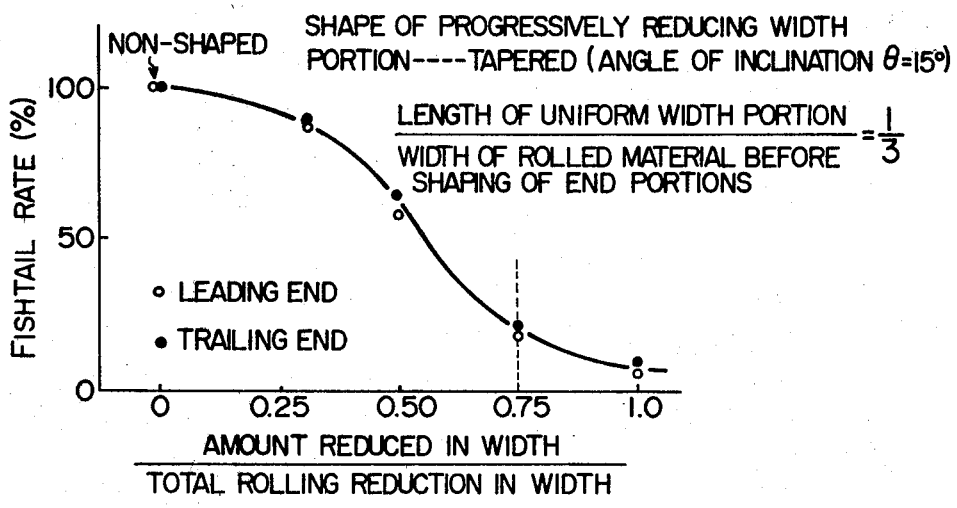
FIG. 7 is a graph showing the relation between the amount of the width reduced in shaping the end portion and the fishtail rate in the invention.

FIG. 7 shows the results of tests conducted on the influences exerted by variations in the amount reduced in width in shaping the end portions of a rolled material or the amount reduced in width in shaping each uniform width portion (the amount corresponding to the width of the rolled material before shaping minus the width of the uniform width portion after shaping) on the amount of fishtail produced when shaping of the end portions of the rolled material is carried out under the aforesaid conditions. In the figure, it will be seen that by setting the amount reduced in width in shaping the end portions of the rolled material (the amount corresponding to the width of the rolled material before shaping minus the width of the uniform width portion) at least $\frac{3}{4}$ the amount of total rolling reduction in width (the amount corresponding to the width of the rolled material before widthwise rolling minus the width of the rolled material after widthwise rolling), it is possible to greatly reduce the amount of fishtail that might be produced in the rolled material when it is rolled widthwise thereof.

In shaping the end portions of a rolled material by reducing the width thereof as described hereinabove, there is no need to reduce the width of each end portion of the rolled material to shape the uniform width portion at the aforesaid rate in a single operation with regard to the total amount of rolling reduction in width to be obtained in the rolled material. Satisfactory results could be obtained in reducing the amount of fishtail by subdividing the total amount of rolling reduction to be obtained in width and by shaping the end portions of the rolled material in such a manner that the reduction in width at the aforesaid rate could be obtained for each of the subdivided amounts of rolling reduction to be obtained in width in rolling the rolled material widthwise thereof.

Figure 8:
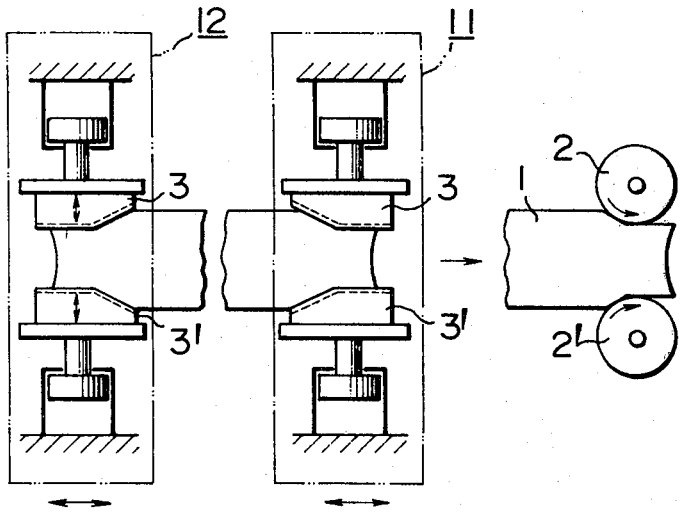
FIGS. 8 and 9 are plan views of the widthwise rolling apparatus comprising other embodiments of the invention.

FIG. 8 shows another embodiment of the widthwise rolling apparatus according to the invention in which two working devices 11 and 12 are provided for simultaneously shaping the leading and trailing end portions of a rolled material. Each of the working devices 11 and 12 has a construction and an actuating mechanism similar to those shown in FIGS. 1 and 2. The shaping tool members 3 and 3' forming a pair each have a shape such that each member can be obtained by dividing each shaping tool member shown in FIG. 1 into two parts widthwise thereof so that the two parts are suitable to shape the leading and trailing end portions respectively of the rolled material. This embodiment offers the advantage that the time required for carrying out a shaping operation can be greatly reduced.

Figure 9:
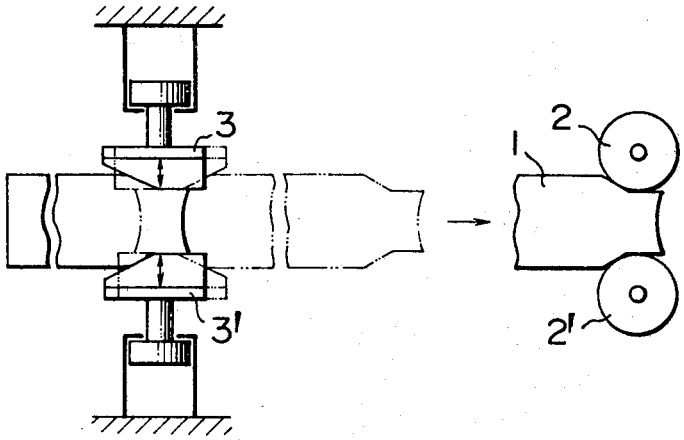

FIG. 9 shows still another embodiment of the widthwise rolling apparatus in conformity with the invention in which only one working device is provided for shaping the leading and trailing end portions of a rolled material. The shaping tool members 3 and 3' shown in FIG. 9 are actuated in solid line positions when they shape the leading end portion, and rotated through 180° from the solid line positions to dash-and-dot line positions when they shape the trailing end portion. This embodiment offers the advantage that a compact overall size can be obtained in a working device.

Figure 10:
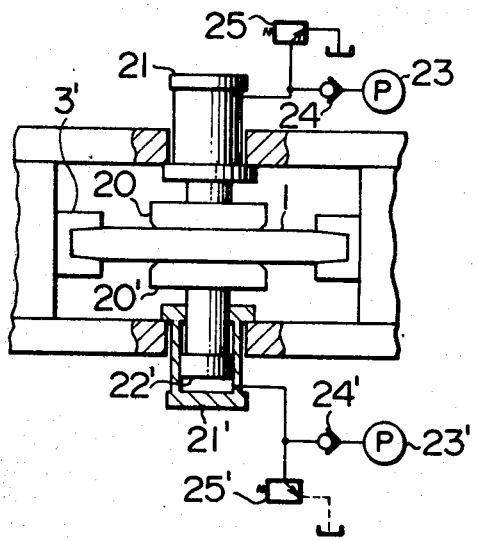
FIG. 10 is a side view of the rolled material keep means.

Shaping end portions of a slab of metal of considerably heavy weight and large size to impart desired tapering thereto requires a great deal of working force, and consequently the installation used necessarily becomes large in size and high in cost. In performing a shaping operation, there is the risk that the slab might be buckled widthwise thereof and desired tapering might be unobtainable. When this is the case, it would become impossible to reduce fishtails when widthwise rolling is carried out because of the absence of desired tapering. In coping with this situation, the use of end portion keep means shown in FIG. 10 has effect. The end portion keep means comprises a pair of keep tool members 20 and 20' in engagement with opposite surfaces of the central portion of the rolled material 1 thicknesswise thereof and connected to pistons 22 and 22' mounted in hydraulic cylinders 21 and 21' respectively for movement toward and away from the rolled material 1. When tapering is imparted to an end portion of the rolled material 1, pumps 23 and 23' are deactuated and the reverse flow of hydraulic fluid is stopped by check valves 24 and 24', and the backward movement of the pistons 22 and 22' that might be caused by an increase in the thickness of the rolled material due to the compression of the rolled material 1 widthwise thereof is effected by relief valves 25 and 25' respectively. Thus the keep load applied to the rolled material 1 can be kept constant by using the keep means shown in FIG. 10.

Figure 11A:
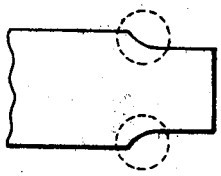
FIGS. 11*a* and 11*b* are plan views in explanation of modifications of the shape of the end portion of the rolled material shaped in the invention.
Figure 11B:
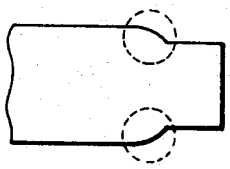

As described hereinabove, the progressively reducing width portion may be either tapered or circularly arcuate in shape, because the shape of the progressively reducing width portion causes no great changes in the amount of fishtail produced in the rolled material when widthwise rolling is carried out. Thus the progressively reducing width portion may have any shape as desired. FIGS. 11*a* and 11*b* show examples of progressively reducing width portion in circularly arcuate form.

In the embodiment shown and described hereinabove, shaping of end portions of a rolled material by compression working has been described as being carried out while the rolled material is kept stationary temporarily. However, it is to be understood that the invention is not limited to this specific form of the embodiments and that even if the rolled material is being moved lengthwise thereof, shaping of the end portion by compression working can be effected so long as the velocity of movement of the rolled material relative to the velocity of the shaping tool members widthwise of the rolled material is zero. Thus this form of embodiment is naturally covered by the scope of the invention. In the embodiments shown and described hereinabove, at least one working device has been described as being located upstream of the widthwise rolling mill with respect to the direction of movement of the rolled material. It is also to be understood that the invention is not limited to this specific form of the embodiments and that at least one working device may be disposed downstream of the widthwise rolling mill. In this case, the rolled material is moved to a predetermined position with respect to the working device while the vertical rolls 2 and 2' of the widthwise rolling mill are moved a large distance away from each other, and then returned to the widthwise rolling mill to effect widthwise rolling after the end portions of the rolled material are shaped to provide a progressively reducing width portion and a uniform width portion in each end portion.

What is claimed is:

1. A method of rolling a rolled material widthwise thereof, comprising the steps of:

shaping a lengthwise end portion of the rolled material by compression working to form therein a progressively reducing width portion in which the width is progressively reduced in going toward the end of the rolled material, and a uniform width portion contiguous with the progressively reducing width portion and having a width equal to the minimum width of the progressively reducing width portion between its end contiguous with the progressively reducing width portion and the end of the rolled material, in such a manner that said uniform width portion has a length at least over $\frac{1}{3}$ the width of the rolled material before having its end portion shaped; and thereafter rolling the rolled material widthwise thereof.

2. A method as claimed in claim 1, wherein the end portion of the rolled material is shaped by compression working in said compression working step in such a manner that the amount reduced in width in forming said uniform width portion is at least over $\frac{3}{4}$ the total amount of rolling reduction in width obtained in said widthwise rolling step.

3. A method of rolling a rolled material in the form of a flat metal having a large width as contrasted with the thickness, such as a slab of metal, widthwise thereof, comprising the steps of:

shaping at least one of a leading end portion and a trailing end portion of the rolled material by compression working while therolled material remains stationary to form therein a progressively reducing width portion in which the width is progressively reduced in going toward the end of the rolled material, and a uniform width portion contiguous with the progressively reducing width portion and having a width equal to the minimum width of the progressively reducing width portion between its end contiguous with the progressively reducing width portion and the end of the rolled material, in such a manner that said uniform width portion has a length at least over $\frac{1}{3}$ the width of the rolled material before having at least one end portion thereof shaped; and rolling the rolled material widthwise thereof.

4. A method as claimed in claim 3, wherein at least one of the lengthwise leading end portion and trailing end portion of the rolled material is shaped by compression working in said compression working step in such a manner that the amount reduced in width in forming said uniform width portions is at least over $\frac{3}{4}$ the total amount of rolling reduction in width obtained in said widthwise rolling step.

5. A method as claimed in claim 1 or claim 3, wherein said step of shaping by compression working is performed while restraining the widthwise edge portions from increasing in thickness.

6. A method as claimed in claim 5, wherein said step of shaping by compression working is performed by engaging simultaneously the widthwise central portion of the material on opposite sides thereof between the endportion to prevent buckling during shaping.

7. A method as claimed in claim 1 or claim 3, wherein said step of shaping by compression working is performed by simultaneously engaging the widthwise central portion of the material on opposite sides thereof between the end portion to prevent buckling during shaping.

8. A method as claimed in claim 1 or claim 3, wherein said step of shaping by compression working is performed by reciprocating a pair of shaping tool members widthwise into the rolled material while maintaining no lengthwise movement between the tool members and rolled material.

9. A method as claimed in claim 1 or claim 3, wherein said step of shaping by compression working is performed by providing angle of inclination in a position in which the width begins to decrease, that is less than or equal to the biting angle of the rolls performing said step of rolling.

10. An apparatus for rolling a rolled material widthwise thereof comprising:

a widthwise rolling mill for rolling the rolled material widthwise thereof; and a working device comprising shaping means and pressing means;

said shaping means being located on at least one of the upstream side and the downstream side of said widthwise rolling mill with respect to the direction of movement of the rolled material being rolled, said shaping means comprising a pair of shaping tool members configured for shaping a lengthwise end portion of the rolled material by compression working in such a manner that the lengthwise end portion has a progressively reducing width portion in which the width is progressively reduced in going toward the end of the rolled material, and a uniform width portion contiguous with the progressively reducing width portion and having a width equal to the minimum width of the progressively reducing width portion between its end contiguous with the progressively reducing width portion and the end of the rolled material, in such a manner that said uniform width portion has a length at least over $\frac{1}{3}$ the width of the rolled material before having its end portion shaped;

said pressing means being operative to urge said shaping means to move toward and away from the rolled material widthwise thereof; and said pair of shaping tool members of said shaping means each comprising substantially symmetrical inclined portions inclined with respect to the center line of the rolled material for shaping both the leading end portion and the trailing end portion of the rolled material to form the progressively reducing width portion therein, and a parallel portion interposed between the inclined portions to form the uniform width portion disposed between the progressively reducing width portion and the end of the rolled material, said parallel portion being parallel to the center line of the rolled material.

11. An apparatus for rolling a rolled material in the form of a flat metal having a large width as contrasted with the thickness, such as a slab of metal, widthwise thereof, comprising:

a widthwise rolling mill for rolling the material widthwise thereof; and a working device comprising shaping means and pressing means;

said shaping means being located on at least one of the upstream side and the downstream side of said widthwise rolling mill with respect to the direction of movement of the rolled material being rolled, said shaping means comprising a pair of shaping tool members configured for shaping a lengthwise end portion of the rolled material by compression working while the rolled material remains stationary in such a manner that the lengthwise end portion has a progressively reducing width portion in which the width is progressively reduced in going toward the end of the rolled material, and a uniform width portion contiguous with the progressively reducing width portion and having a width equal to the minimum width of the progressively reducing width portion between its end contiguous with the progressively reducing width portion and the end of the rolled material, in such a manner that said uniform width portion has a length at least over $\frac{1}{3}$ the width of the rolled material before having its end portion shaped;

said pressing means being operative to urge said shaping means to move toward and away from the rolled material widthwise thereof; and said pair of shaping tool members of said shaping means each comprising substantially symmetrical inclined portions inclined with respect to the center line of the rolled material for shaping both the leading end portion and the trailing end portion of the rolled material to form the progressively reducing width portion therein, and a parallel portion interposed between said inclined portions to form the uniform width portion between the progressively reducing width portion and the end of the rolled material, said parallel portion being parallel to the center line of the rolled material.

12. An apparatus as claimed in claim 11, wherein said apparatus comprises a plurality of working devices, one working device being located upstream of said widthwise rolling mill for shaping the leading end portion of the rolling material by compression working, and the other working device being located upstream of said one working device for shaping the trailing end portion of the rolled material by compression working, whereby the leading end portion and the trailing end portion of the rolled material can be simultaneously shaped.

13. An apparatus as claimed in claim 11, wherein said pair of shaping tool members of said shaping means are each formed with a groove in the form of a letter U in lying position in cross section, whereby each end portion of the rolled material can be held in one of the grooves.

14. An apparatus as claimed in claim 11, further comprising keep means for pressing each end portion of the rolled material thicknesswise thereof when the end portions are shaped by compression working.

15. An apparatus as claimed in claim 10 or claim 11, wherein said widthwise rolling mill has a fixed roll bite angle; and wherein said shaping tool members have an angle of inclination in a position in which the width begins to decrease for the rolled material, which is less than or equal to said biting angle.

* * * * *